US012618651B2

(12) United States Patent
Hagberg et al.

(10) Patent No.: US 12,618,651 B2
(45) Date of Patent: May 5, 2026

(54) SHORT-RANGE PROJECTILE

(71) Applicant: BAE SYSTEMS BOFORS AB, Karlskoga (SE)

(72) Inventors: Anders Hagberg, Karlskoga (SE); Christer Thuman, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 17/922,852

(22) PCT Filed: May 4, 2021

(86) PCT No.: PCT/SE2021/050416

§ 371 (c)(1),
(2) Date: Nov. 2, 2022

(87) PCT Pub. No.: WO2021/235989

PCT Pub. Date: Nov. 25, 2021

(65) Prior Publication Data

US 2023/0194222 A1 Jun. 22, 2023

(30) Foreign Application Priority Data

May 22, 2020 (SE) ..... 2000094-9

(51) Int. Cl.

| | |
|---|---|
| ***F42B 10/48*** | (2006.01) |
| ***F42B 8/14*** | (2006.01) |
| ***F42B 10/34*** | (2006.01) |
| ***F42B 10/52*** | (2006.01) |
| ***F42C 1/12*** | (2006.01) |

(52) U.S. Cl.
CPC ..... *F42B 8/14* (2013.01); *F42B 10/34* (2013.01); *F42B 10/52* (2013.01); *F42C 1/12* (2013.01)

(58) Field of Classification Search
CPC ..... F42B 8/12; F42B 10/48; F42B 10/50
See application file for complete search history.

(56) References Cited

U.S. PATENT DOCUMENTS

| | | | | | |
|---|---|---|---|---|---|
| 32,986 | A | * | 8/1861 | Dahlgren | F42B 14/064 102/520 |
| 178,595 | A | * | 6/1876 | Butler | F42B 14/02 102/525 |
| 390,249 | A | * | 10/1888 | Paulson | F42B 12/58 102/480 |

(Continued)

FOREIGN PATENT DOCUMENTS

| | | | |
|---|---|---|---|
| AT | 376498 | B | 11/1984 |
| DE | 10103396 | A1 | 2/2002 |

(Continued)

OTHER PUBLICATIONS

International Search Report (May 19, 2021) for corresponding International App. PCT/SE2021/050416.

*Primary Examiner* — Derrick R Morgan
(74) *Attorney, Agent, or Firm* — Husch Blackwell LLC

(57) ABSTRACT

A projectile for short firing ranges includes as a cylinder with a nose having a substantially flat surface arranged with a threaded socket allowing for the arrangement of, for example, a fuze a rear section designed with a substantially flat surface, as well as a projectile body arranged with energetic material enclosed by a casing.

9 Claims, 6 Drawing Sheets

(56) References Cited

U.S. PATENT DOCUMENTS 463,528 A * 11/1891 Mieg ..... F42B 8/02 102/447
493,735 A * 3/1893 Rapp ..... F42C 1/02 102/272
1,090,007 A * 3/1914 Ziegenfuss ..... F42B 4/26 102/338
1,181,203 A * 5/1916 Name not available ..... F42B 10/50 244/3.28
1,188,178 A * 6/1916 Isham ..... F42B 10/46 102/398
1,232,590 A * 7/1917 Mills ..... F42C 14/02 102/487
1,296,171 A * 3/1919 Dingwall et al. ..... F42B 12/204 102/499
1,303,738 A * 5/1919 Stone ..... F42B 10/46 102/398
1,305,187 A * 5/1919 Bergman ..... F42B 10/56 102/354
1,311,793 A * 7/1919 Driggs ..... F42C 15/22 102/241
1,315,113 A * 9/1919 Gilmartin ..... F42B 12/60 102/497
1,321,407 A * 11/1919 Taylor ..... F42C 15/36 102/222
1,351,498 A * 8/1920 Strang ..... F42B 10/46 102/519
1,508,450 A * 9/1924 Goss ..... F42C 9/12 102/277.2
1,543,689 A * 6/1925 Wiley ..... F42C 9/10 102/272
1,614,536 A * 1/1927 Pantoflicek ..... F42C 15/22 102/276
1,890,175 A * 12/1932 Brandt ..... F42B 10/14 102/385
2,090,533 A * 8/1937 Howdeshell ..... F42B 10/34 244/130
2,091,635 A * 8/1937 Hayden ..... F42B 12/625 102/490
2,197,841 A * 4/1940 Slaughter ..... F42C 19/02 264/324
2,304,060 A * 12/1942 Baylor ..... F42B 12/64 102/497
2,315,145 A * 3/1943 Wauters ..... F42B 30/12 102/373
2,359,814 A * 10/1944 Wauters ..... F42B 10/56 102/340
2,372,383 A * 3/1945 Lee ..... F41H 13/0006 102/504
2,403,567 A * 7/1946 Wales, Jr. ..... F42C 15/38 429/114
2,412,151 A * 12/1946 Holmes, Jr. ..... F42B 12/58 102/480
2,764,092 A * 9/1956 Massey ..... F42C 1/10 102/499
2,856,852 A * 10/1958 Hinman, Jr. ..... F42C 13/04 342/68
3,000,308 A * 9/1961 Land ..... F42B 12/76 60/39.47
3,023,704 A * 3/1962 Dawson ..... F42B 30/10 102/525
3,064,578 A * 11/1962 Henderson ..... F42C 13/02 250/214 RC
3,094,934 A * 6/1963 Anthony ..... F42B 12/40 102/513
3,164,091 A * 1/1965 Urdapilleta ..... F42B 12/26 102/482
3,292,879 A * 12/1966 Seward ..... F42B 29/00 244/3.3
3,477,376 A * 11/1969 Blatt ..... F42B 10/46 102/399
3,485,460 A * 12/1969 Mertens ..... F42B 10/52 102/517
3,580,179 A * 5/1971 Gawlick ..... F42B 10/34 102/513
3,620,162 A * 11/1971 King ..... F42B 30/06 42/105
3,677,182 A * 7/1972 Peterson ..... F42B 12/62 102/505
3,713,386 A 1/1973 Zaid
3,722,417 A * 3/1973 Robinson, Jr. ..... F42C 13/04 102/214
3,726,495 A * 4/1973 Gawlick ..... F42B 10/34 102/503
3,995,558 A * 12/1976 Travor ..... F42B 10/38 244/3.1
4,008,667 A * 2/1977 Look ..... F42B 10/50 244/3.28
4,015,528 A * 4/1977 Barr ..... F42B 14/064 102/518
4,016,817 A * 4/1977 Arciniega Blanco ... F42B 10/22 244/3.23
4,126,955 A * 11/1978 Coffield, Jr. ..... F42B 14/068 89/14.6
4,175,492 A * 11/1979 Knappworst ..... F42B 12/34 102/517
4,208,968 A * 6/1980 Hubsch ..... F42B 8/12 102/513
4,297,948 A * 11/1981 Donovan ..... F42B 10/48 102/501
4,413,566 A * 11/1983 Loeb ..... F42B 10/52 102/517
4,436,035 A * 3/1984 Strandli ..... F42B 10/34 102/517
4,635,556 A * 1/1987 Boecker ..... F42B 12/06 102/518
5,001,986 A * 3/1991 Meister ..... F42B 10/48 102/498
5,200,573 A * 4/1993 Blood ..... F42B 7/046 102/501
6,345,785 B1 * 2/2002 Harkins ..... F42B 15/01 244/3.21
7,163,176 B1 * 1/2007 Geswender ..... F42B 10/64 102/490
8,844,444 B1 * 9/2014 Hooke ..... F42B 35/00 102/524
9,121,679 B1 * 9/2015 Kim ..... F42B 8/12
9,329,008 B1 * 5/2016 Gilbert ..... F42B 12/02
11,015,907 B2 * 5/2021 Heiche ..... F42B 35/00
11,959,734 B2 * 4/2024 Wilkes ..... F42B 14/02
2018/0321021 A1 * 11/2018 Teig ..... F42B 12/02
2022/0221256 A1 * 7/2022 Biafore, Jr. ..... F42B 5/24

FOREIGN PATENT DOCUMENTS

GB 840257 A 7/1960
GB 1363495 A 8/1974
GB 2105444 A 3/1983
KR 20100088490 A 8/2010
WO WO-0212820 A1 * 2/2002 ..... F42B 10/48

* cited by examiner

SHORT-RANGE PROJECTILE

BACKGROUND AND SUMMARY

The present invention relates to a projectile for short firing ranges, where the projectile is designed as a cylinder with a nose having a substantially flat surface arranged with a threaded socket allowing for the arrangement of, for example, a fuze a rear section designed with a substantially flat surface, as well as a projectile body arranged with energetic material enclosed by a casing.

Barrel weapons, such as cannons, make use of projectiles that are fired by means of a propellant, frequently gunpowder, during the formation of gas pressure that propels a projectile out through the barrel. A certain amount of propellant is used up in order to enable for the projectile to be propelled out through the barrel in a safe manner. In most cases, it is desirable to fire the projectiles with a long firing range, which results in the systems being designed in order to allow for long firing ranges. Depending on the circumstances or requirements, short firing ranges may also be desired. Currently, short firing ranges are achieved in part by firing current ammunition with as low propellant as possible, and, in part, by ensuring that the elevation of the firing is as high as possible, which means that the firing range of the projectiles is short, but that they travel with a relatively high trajectory.

Patent document GB 2 105 444 describes a training projectile for battle vehicles which has been adapted to short or, alternatively, long firing ranges, and is designed with a removable tap/rod which can be removed when short firing ranges are desired. For instance, the tap can be threaded to the projectiles. The patent document does not show the projectile including an operational part, and only a training projectile is described.

Patent document U.S. Pat. No. 3,713,386 shows a short-range projectile for weapons of fine caliber which includes a reverse rocket engine which, upon initiation, creates an opposing force which affects the projectile and stops its trajectory at a certain predetermined point. The patent document does not show any operational part including energetic materials, and it furthermore shows a technically complex and costly solution to the problem of reducing the firing range.

It is desirable to solve the problems identified above.

According to an aspect of the present invention a projectile for short firing ranges is designed as a cylinder with a nose having a substantially flat surface arranged with a threaded socket allowing for the arrangement of, for example, a fuze a rear section designed with a substantially flat surface, as well as a projectile body arranged with energetic material enclosed by a casing.

According to additional aspects for a projectile with a short firing range, the following applies;

- that a measurement, from the outer radius of the projectile to a point in the center of the projectile on the nose of the projectile, the cone height, is less than 20 mm.
- that a measure, from the outer radius of the projectile to a point in the center of the projectile on the nose of the projectile, the cone height, is less than 15% of the diameter of the projectile.
- that the projectile is arranged with a belt or a sealing ring.
- that the projectile is arranged with a convex nose section.
- that the projectile is arranged with a concave rear section.
- that the projectile is arranged with a concave nose section.

That the projectile is arranged with a fuze arranged in the threaded socket.

- that a fuze is arranged to burst upon being struck.
- that a fuze is arranged to burst upon reaching a certain altitude.
- that a fuze is arranged to burst at a certain time.
- that the projectile is arranged with a braking device.

BRIEF DESCRIPTION OF THE DRAWINGS

The invention will be described below by reference to the figures that are included there.

DETAILED DESCRIPTION

Figure 1:
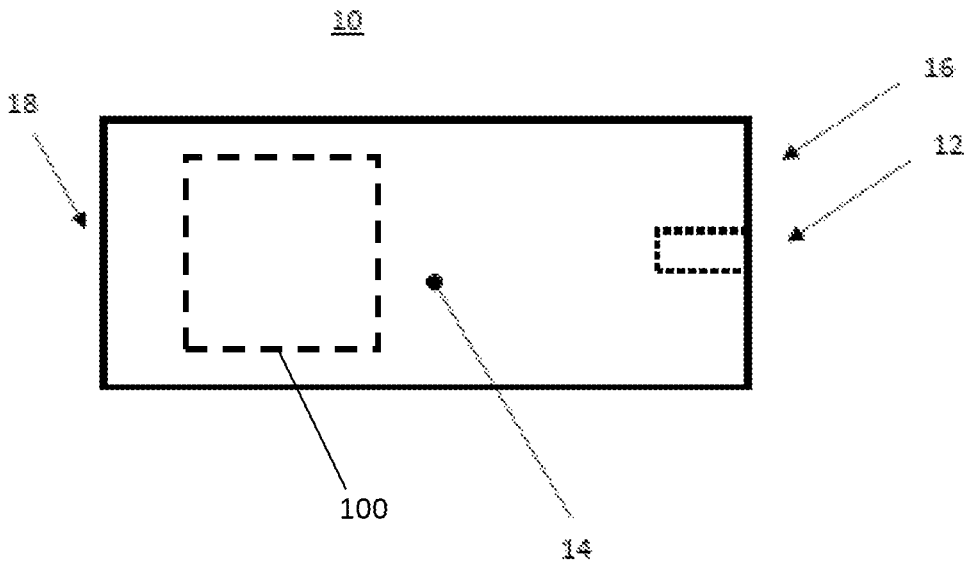
FIG. 1 shows a projectile viewed from the side according to one embodiment of the invention.

An ejection device, also termed a cannon, a howitzer or a piece, in the sense of an artillery piece, has to goal of making use a propellant for the purpose of firing, or ejecting, a projectile. Preferably, a propellant, such as gunpowder, is initiated in one part of the cannon, oftentimes a chamber specifically adapted to the purpose. Initiation takes place by way of igniting the fuze, for instance by means of an ignition cartridge or an ignited in an ammunitions device, which is initiated by means of striking. Other methods for igniting the propellant may include ignition of the propellant by means of laser energy or electric energy. The propellant burns at a high rate and results in large amounts of gas being produced, which creates a gas pressure in the chamber which propels the projectile out of the barrel of the firing ejection device. The propellant has been adapted in order to generate a constant pressure on the projectile during the entire barrel procedure, to the greatest extent possible, as the projectile movies in the barrel, which results in the projectile leaving the mouth of the barrel with high speed.

Projectiles, such as various types of grenades, generally include some form of operational part and some form of fuze which initiates the operational part. Fuzes can be of various types, and it is common that projectiles intended to burst upon coming into contact with objects to be of the type that requires being struck. Other types of barrels include time barrels, in which projectiles are arranged for purposes of bursting at a certain predetermined time, and zone barrels, in which projectiles are arranged for purposes of bursting when an object comes within a certain distance from the projectile. The use of zone barrels is preferred when confronting flying vessels, while timed barrels can be used when confronting a large number of various objects. It is advantageous to combine various types of barrel functions in one and the same barrel, for instance in order for the projectile to burst after a certain time if it fails to detect any object, and so on.

It is advantageous for the operational part to comprise some type of explosive substance, as well as some type of shattering casing which encloses the explosive substance. Various types of propellants, such as fins, can furthermore be arranged in either fuze or on the body of the projectile.

Projectiles intended for artillery purposes generally include an operational part, a grenade and a fuze, which are arranged on the grenade prior to the projectile being arranged, rammed, in the fuze cannon. The reasons that the fuze is not arranged along with the grenade prior to being employed. The fuze is generally arranged with threads and is screwed on to the grenade/body of the projectile. The fuze can also be programmed, such as by means of modifying the fuze mechanically, for instance by turning part of the fuze to a certain desired position. Alternatively, the fuze can be programmed electronically, such as by bringing it in contact with the fuze or by means of inductive/capacitive programming.

A certain amount of propellant is used up in order to enable for the projectile to be propelled out through the barrel in a safe manner. In most cases, it is desirable to fire the projectiles with a long firing range, which results in the systems being designed in order to allow for long firing ranges. Depending on the circumstances or requirements, short firing ranges may also be desired. Currently, short firing ranges are achieved in part by firing current ammunition with as low propellant as possible, and, in part, by ensuring that the elevation of the firing is as high as possible, which means that the firing range of the projectiles is short, but that they travel with a relatively high trajectory.

By adapting the projectiles so that larger air resistance is achieved, it becomes possible to achieve short firing ranges. If the projectile is arranged using a flat, or substantially flat, nose section, larger air resistance can thus be generated which results in a short firing range. When the projectile is arranged with a flat nose section, the rear section is also flat, or primarily flat, or substantially flat. A projectile with a flat nose section and a flat rear section takes on a cylindrical shape, which also facilitates the production of projectiles, meaning that a short-range grenade produced in the form of a cylinder can be considered to be cost-effective in comparison with conventional projectiles. For instance, the body of the projectile is manufactured using conventional pipes or pipe elements available for sale, and do not have to be explicitly manufactured for the purpose.

FIG. 1 shows a projectile 10 adapted for short firing ranges, including a projectile body 14, a nose section 16 and a rear section 18, where the nose 16 of the body of the projectile (14) is arranged with a holder device (12) for purposes of arranging a fuze. The nose section 16 is primarily flat, or mainly flat, which results in large air resistance which results in the firing range of the projectile becoming short. The projectile 10 shown in FIG. 1 is especially designed in order to be fired from smooth-bored fuzes which lack threads. When the projectile has been fired from the ejection device and, having left the mouth of the fuze, is traveling towards its target, a large cross-section, through the flat nose, will run into air molecules. The large cross-section created by a flat nose section results in large air resistance which significantly affects the firing range in a negative fashion, in the sense that it makes the firing range short and results in short firing ranges.

Figure 2:
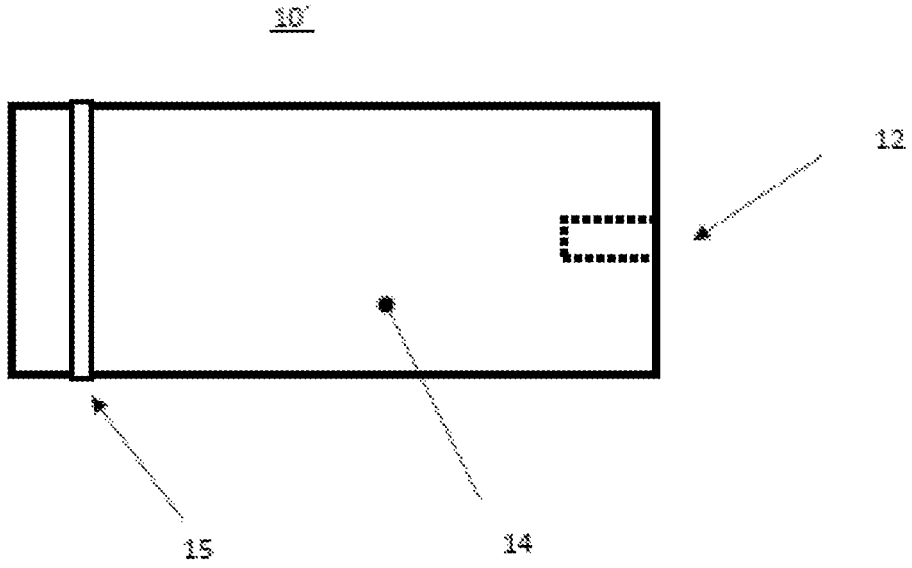
FIG. 2 shows a projectile viewed from the side according to a second embodiment of the invention.

FIG. 2 shows an alternative embodiment of projectile 10', arranged with a belt 15 on the body of the projectile 14. The body of the projectile 14 is arranged with a holder device 12 for purposes of arranging a fuze in the nose. A belt 15 is arranged on projectiles intended to be fired in a fuze having threads, which results in the projectile being rotated while it is being fired. The rotation of a rotating projectile becomes stabilized. In an additional alternative embodiment, the belt is arranged in a spinning fashion, in order to avoid rotating the projectile while it is being fired. A belt is a component arranged around the body of the projectile, preferably manufactured out of soft metal, such as copper, and including a composite or plastic material. The projectile can also be designed using a sealing ring in order to provide a seal when the projectile 10' is being fired from a smooth-bored fuze.

Figure 3:
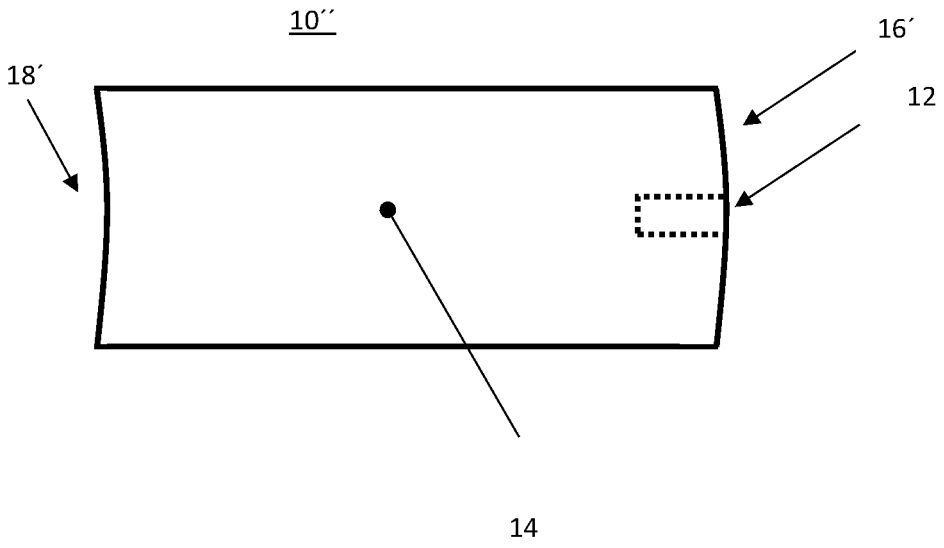
FIG. 3 shows a projectile viewed from the side according to a third embodiment of the invention.

FIG. 3 shows an embodiment of the projectile" with its nose section 16' having a convex design. In the shown embodiment, the rear section 18' has a concave design in order to facilitate the storage of several projectiles 10", whereas the convex nose section 16' of a first projectile can meet the concave rear section 18' of a second projectile 10". The projectile can also be designed with a flat rear section. Furthermore, the body of the projectile 14 is arranged with a holder device 12 for purposes of arranging a fuze in the nose.

Figure 4:
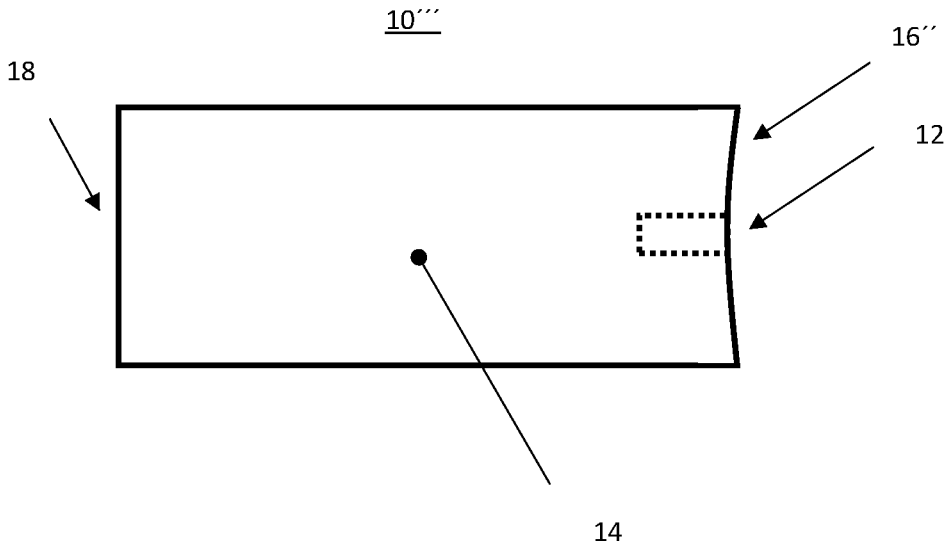
FIG. 4 shows a projectile viewed from the side according to a fourth embodiment of the invention.

FIG. 4 shows an embodiment of the projectile'" with its nose section 16' having a concave design. Furthermore, the body of the projectile 14 is arranged with a holder device 12 for purposes of arranging a fuze in the nose. In an additional alternative embodiment, in a figure not shown, the rear section might be convex in order to meet the concave tip section and thereby facilitate the storage of projectiles.

Figure 5:
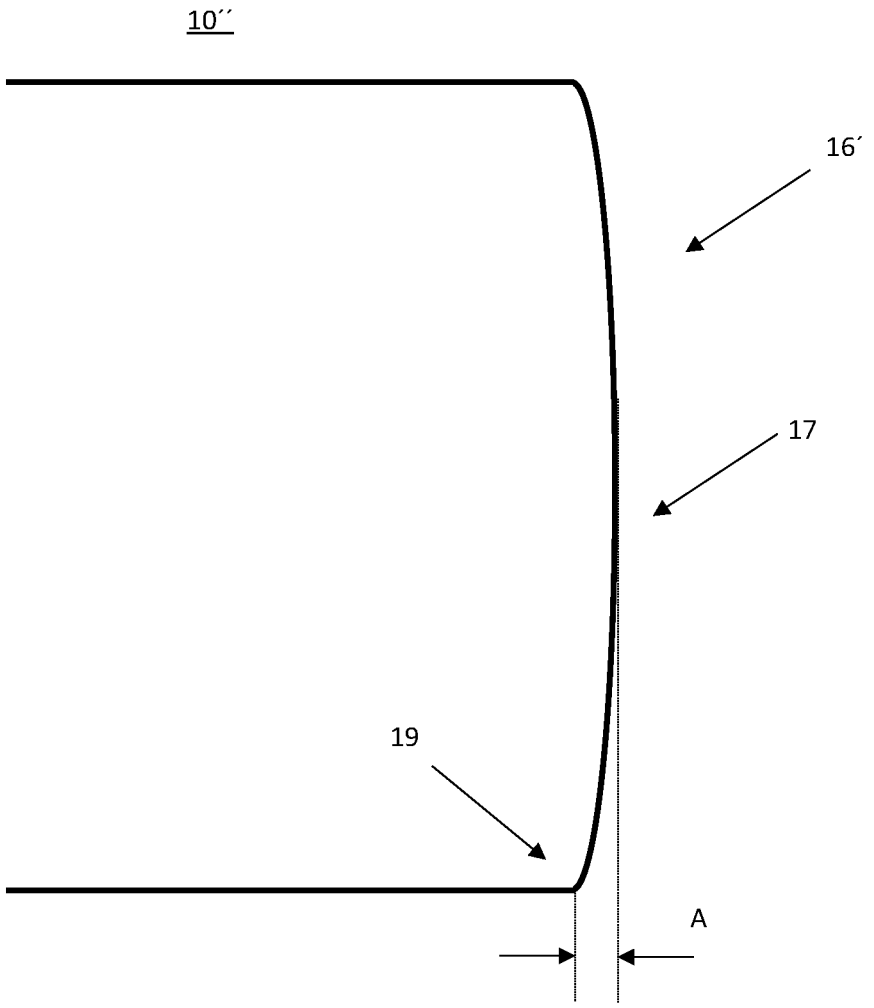
FIG. 5 shows an enlarged part of the nose of the projectile according to one embodiment of the invention.

FIG. 5 shows an enlarged part of the nose section 16' of a projectile 10" where the nose section has a convex design. Measurement A, the cone height, specified from a point 19 on the outer radius of the projectile and point 17 in the center of the projectile on the nose section 16' of the projectile. Point 19, in the outer radius, is the point closest to the nose where the projectile has a maximum radius, in the regular case where the radius corresponds to the caliber of the projectile. Cone height A is a maximum of 20 mm in order for a substantially flat nose section to be achieved. The cone height is a measurement that extends in an an axial direction.

Figure 6:
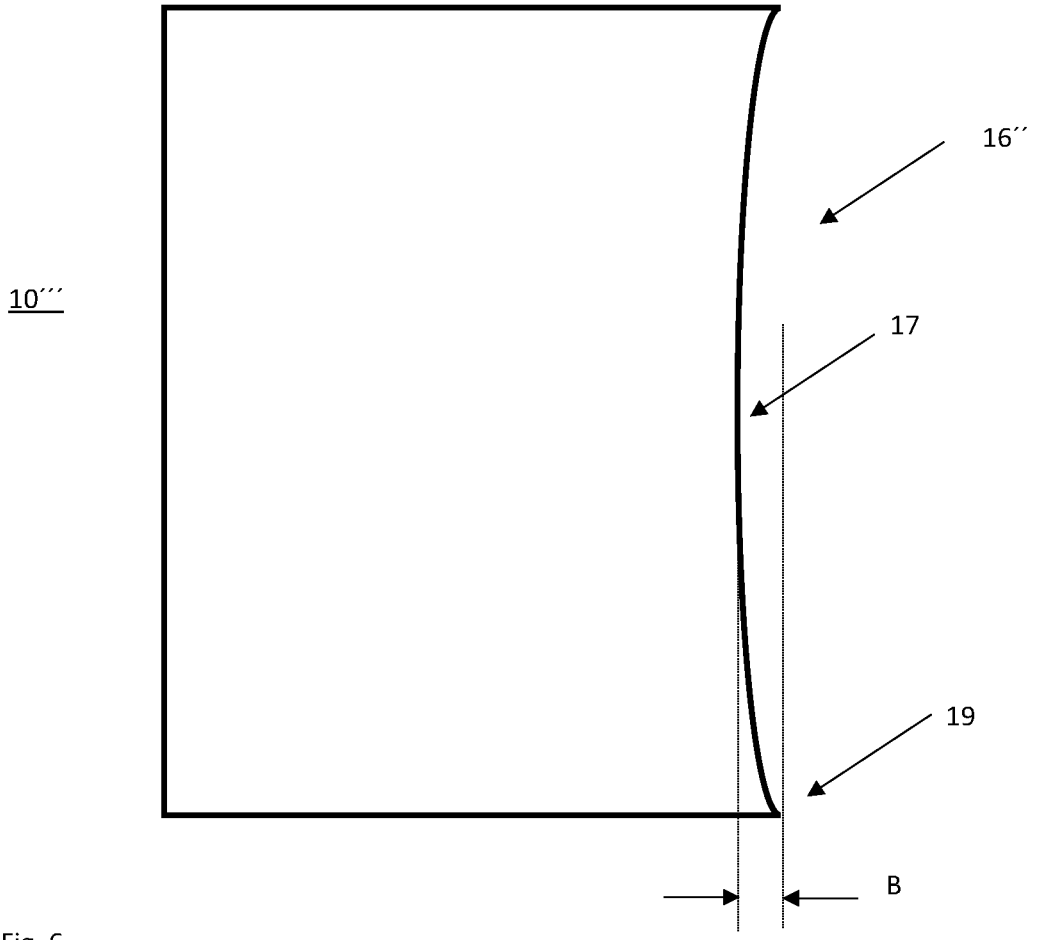
FIG. 6 shows an enlarged part of the nose of the projectile according to an alternative embodiment of the invention.

FIG. 6 shows an enlarged part of the nose section 16" of a projectile 10'" where the nose section has a concave design. Measurement B, the cone height, specified from a point 19 on the outer radius of the projectile and point 17 in the center of the projectile on the nose section 16" of the projectile. Point 19, in the outer radius, is the point closest to the nose where the projectile has a maximum radius, in the regular case where the radius corresponds to the caliber of the projectile. Cone height B is a maximum of 20 mm in order for a substantially flat nose section to be achieved. The cone height is a measurement that extends in an an axial direction.

Figure 7:
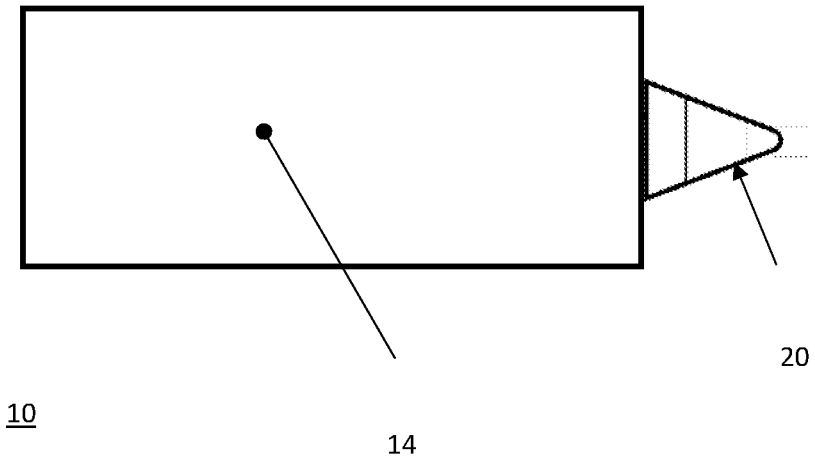
FIG. 7 shows a projectile arranged with a fuze viewed from the side according to one embodiment of the invention.

FIG. 7 shows a projectile 10 arranged with a fuze 20. As the projectile 10 is arranged with a fuze, the projectile is prepared in order to be deployed in a firing device. Preferably, the fuze 20 is arranged shortly before being deployed, in a timely fashion, using a process known as accommodation. The fuze initiates an operational part arranged in the body of the projectile 14, when the projectile, for instance, strikes a target object, also termed a strike burst. It is also possible to arrange for a burst to take place at a certain time, also known as a timed fuze burst, or at a certain altitude of height of trajectory, also known as HOB (Height of Burst).

Figure 8:
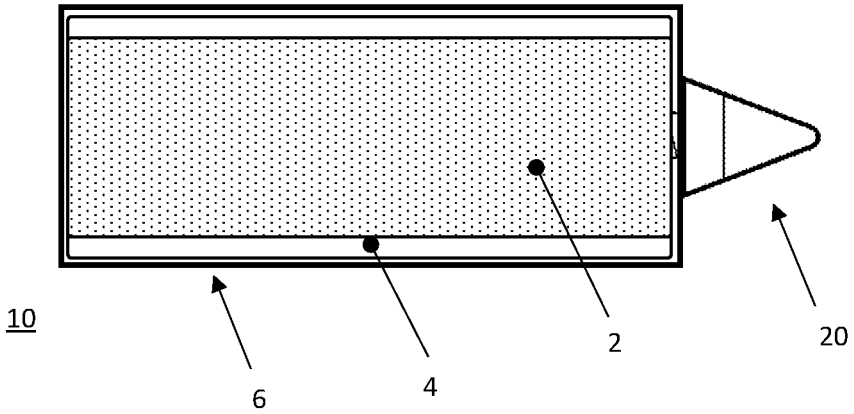
FIG. 8 shows a projectile arranged with a fuze through a cross section viewed from the side according to one embodiment of the invention.

FIG. 8 shows a projectile 10, where its fuze 20 has been arranged in order to be able to initiate an energetic material, preferably an explosive 2, which is arranged inside the projectile 10, enclosing the explosive 2 is a casing capable of emitting shrapnel 4, including shrapnel, such as heavy metal bullets, or where the casing is manufactured so as to include weak areas emitting shrapnel. Furthermore, an outer casing 6 can be designed in order to enclose the casing capable of emitting shrapnel. In an alternative embodiment, the outer casing 6 and the casing 4 capable of emitting shrapnel have been joined into one single component. The fuze is arranged so that the fuze is initiated, such as by means of the fuze striking the target object, so that the ignition chain can be completed by an igniting substance/primary explosive in the fuze can cause denotation of the projectile. For instance, the igniting substance can be initiated by means of an initial explosive which is initiated by means of physical deformation of, for instance, a detonator arranged with initial igniting substance. The igniting substance can also be initiated electronically, e.g. Using a so-called slapper or an EBW (Exploding Bridge Wire).

In order to further shorten the firing range, the projectile may be arranged with a brake device 100 (shown schematically in FIG. 1 in plantom), such as brake panels, a brake screen, such as a falling screen, or an engine, such as a rocket engine.

Examples of short-range grenades include projectiles with calibers 80-155 mm arranged with fuzes arranged with functions based on striking, time or zone fuzes, as well as a projectile body arranged with functions that make it capable of emitting shrapnel or exploding. The length of the projectile, excluding the fuze, is preferably between 100-600 mm.

The invention is not limited to the types of design specifically shown, but can be varied in different ways within the framework of the claims.

For instance, it is clear that the number, size, material and shape of the elements and details included in the short-range grenade are to be adapted according to the projectile(s) and projectile compositions, along with other construction-related properties, which are applicable to each individual case.

For instance, the projectile can be arranged so that it is capable of exploding, emitting shrapnel, catching fire, exerting a thermobaric effect, fighting fires, to be used as a training projectile, in light kits, in smoke kits, to exert electromagnetic effect, bring about electromagnetic disturbances or other loads and functions.

The invention claimed is:

1. A projectile for short firing ranges, comprising:

a cylindrical projectile body, the projectile body having a forward end and a rear end, the forward end and the rear end being identical in cross-section;

a nose at the forward end of the projectile body, the nose having a flat section centered along a longitudinal axis of the nose that includes a threaded socket arranged with a fuze;

a rear section at the rear end of the projectile body;

the projectile body including an energetic material surrounded by a casing;

the nose further having a convexity or concavity, wherein a height of the convexity or the concavity measured along the longitudinal axis of the nose is less than 15% of a maximum diameter of the projectile, and wherein the nose is at least partially exposed behind the fuze and the nose is configured to create an increase in air resistance.

2. The projectile for short firing ranges according to claim 1, wherein the height of the convexity or concavity is less than 20 mm.

3. The projectile for short firing ranges according to claim 1, wherein the projectile includes a belt or a sealing ring.

4. A projectile for short firing ranges, comprising:

a cylindrical projectile body, the projectile body having a forward end and a rear end, the forward end and the rear end being identical in cross-section;

a nose at the forward end of the projectile body, the nose having a convex surface and a flat surface, said flat surface arranged with a threaded socket arranged with a fuze;

a rear section at the rear end of the projectile body;

the projectile body including an energetic material surrounded by a casing;

the convex surface of the nose having a convexity centered along a longitudinal axis of the nose and surrounding the flat surface, a height of the convexity measured along the longitudinal axis of the nose being less than 15% of a maximum diameter of the projectile, and wherein the nose is at least partially exposed behind the fuse and the nose is configured to create an increase in air resistance.

5. A projectile for short firing ranges, comprising:

a cylindrical projectile body, the projectile body having a forward end and a rear end, the forward end and the rear end being identical in cross-section;

a nose at the forward end, the nose having a threaded socket arranged with a fuze wherein the nose has a flat section and a convex section, wherein a height of the convexity being less than 15% of a maximum diameter of the projectile;

a concave rear section at the rear end, the projectile body including an energetic material surrounded by a casing, the concave rear surface having a concavity centered along a longitudinal axis of the concave rear surface, a height of the concavity measured along the longitudinal axis of the concave rear surface being less than 15% of a maximum diameter of the projectile, wherein the concave rear section is sized to match the convexity of the nose section, and wherein the nose is at least partially exposed behind the fuse and the nose is configured to create an increase in air resistance.

6. The projectile for short firing ranges according to claim 1, wherein the fuze is arranged to burst upon being struck and/or after a certain amount of time.

7. The projectile as set forth in claim 1, wheren the projectile body is made from a pipe.

8. The projectile as set forth in claim 4, wheren the projectile body is made from a pipe.

9. The projectile as set forth in claim 5, wheren the projectile body is made from a pipe.

* * * * *